US011136970B2

(12) United States Patent
Garner

(10) Patent No.: US 11,136,970 B2
(45) Date of Patent: Oct. 5, 2021

(54) POSITIVE DISPLACEMENT PUMP WITH SHAFT-MOUNTED SLEEVE

(71) Applicant: Ampco Pumps Company, Glendale, WI (US)

(72) Inventor: Bob Garner, Sturtevant, WI (US)

(73) Assignee: Ampco Pumps Company, Glendale, WI (US)

( * ) Notice: Subject to any disclaimer, the term of this patent is extended or adjusted under 35 U.S.C. 154(b) by 260 days.

(21) Appl. No.: 16/362,900

(22) Filed: Mar. 25, 2019

(65) Prior Publication Data

US 2020/0032783 A1 Jan. 30, 2020

Related U.S. Application Data

(63) Continuation-in-part of application No. 16/045,098, filed on Jul. 25, 2018, now abandoned.

(51) Int. Cl.

| | |
|---|---|
| ***F04D 29/10*** | (2006.01) |
| ***F04D 29/12*** | (2006.01) |
| ***F04C 27/00*** | (2006.01) |
| ***F04D 25/02*** | (2006.01) |
| ***F04B 39/12*** | (2006.01) |
| ***F16J 15/54*** | (2006.01) |

(52) U.S. Cl.
CPC ..... *F04B 39/121* (2013.01); *F04D 25/02* (2013.01)

(58) Field of Classification Search
CPC ..... F16J 15/54; F04B 39/121; F04D 25/02; F04C 15/0038; F04C 15/003; F04C 15/0019; F04C 29/10; F04C 29/12; F04C 15/0003; F04C 2240/605
USPC ..... 418/102, 104, 206.6
See application file for complete search history.

(56) References Cited

U.S. PATENT DOCUMENTS

| | | | | |
|---|---|---|---|---|
| 4,153,400 | A | 5/1979 | Morita | |
| 4,621,994 | A * | 11/1986 | Ellis | F04C 15/0076 418/206.1 |
| 6,328,547 | B1 | 12/2001 | Morita | |
| 7,905,717 | B2 | 3/2011 | Whittome et al. | |
| 8,007,264 | B2 | 8/2011 | Drew et al. | |
| 9,062,676 | B2 | 6/2015 | Garner | |
| 9,273,555 | B2 | 3/2016 | Garner et al. | |
| 10,359,043 | B2 * | 7/2019 | Miyatake | F04C 29/02 |
| 2002/0159906 | A1 | 10/2002 | Phallen et al. | |
| 2007/0071616 | A1 * | 3/2007 | Owen | F04C 15/0069 417/410.4 |
| 2007/0158151 | A1 | 7/2007 | Deconti | |
| 2008/0069707 | A1 | 3/2008 | Van Norman et al. | |
| 2015/0064041 | A1 | 3/2015 | Gamer | |

OTHER PUBLICATIONS

US 5,126,386 A, 10/2000, Kohyama (withdrawn)

(Continued)

*Primary Examiner* — Deming Wan
(74) *Attorney, Agent, or Firm* — Quarles & Brady LLP

(57) ABSTRACT

A rotary positive displacement pump comprising a pair of forwardly-positioned sealing arrangements and a pair of forwardly-positioned sleeves are received within a cavity providing for easy maintenance of the pump when the seals need to serviced. Each of the sealing arrangement includes a dynamic seal and a static seal. The dynamic seal abuts a corresponding sleeve and hub while a static seal is established between the corresponding sleeve and rotor.

20 Claims, 4 Drawing Sheets

(56) References Cited

OTHER PUBLICATIONS

Alfa Laval; Positive Displacement Pumps—Pure and Simple; product brochure; copyright 2001; 8 pages.
Alfa Laval; SX Rotary lobe pump description; http://www.alfalaval.com/solution-finder/products/sx-rotary-lobe-pump/pages/howitworks.aspx; dated printed: Aug. 30, 2012; 1 page.
IDEX Corporation—Viking Pump; Classic+ Industrial Lobe Pumps product description; Sep. 2007; 8 pages.
JEC Pump website product description; http://www.jecpump.com/product/01_3view.html; printed Aug. 30, 2012; listed copyright date 2006; 2 pages.
JEC Pumps; Always a Step Ahead product brochure; obtained from http://www.prestigepumps.co.uk/data/downloads/JEC_2010_general.pdf Pdf creation date 2010, per document properties; 12 pages.
SPX Corporation—Waukesha Cherry-Burrell; Universal 1 Series Rotary Positive Displacement Pumps Brochure, Issued Jan. 2012, pp. 1-12.
SPX Corporation—Waukesha Cherry-Burrell; Universal 1 Series Rotary Positive Displacement Pumps Instruction Manual; Issued Apr. 2010, pp. 1-104.
SPX Corporation—Waukesha Cherry-Burrell; Universal 2 Series product description; Nov. 2011; 12 pages.
Tri-Clove; TCIP Pump Service & Installation Manual; obtained from http://www.flowtrend.com/manuals/Alfa%20Laval%20-%20Tri%20Clover%20Service%20Manuals/Positive%20Displacement%20Pumps/TCIP%20Series.pdf; PDF modification date 2004, per document properties; 52 pages.
Wright Flow Technologies; Installation, Operation and Maintenance Manual for the Revolution Range of Pumps; Issue C—May 21, 2012, pp. 1-74.
ZM Technologies; Zero Maintenance Pumps, The Standard ZW U1 Pump & The Evolution Pump brochure, obtained at Nov. 2011 trade show, 2 pages.

* cited by examiner

POSITIVE DISPLACEMENT PUMP WITH SHAFT-MOUNTED SLEEVE

CROSS-REFERENCE TO RELATED APPLICATIONS

This application is a continuation-in-part application of and claims the benefit of U.S. patent application Ser. No. 16/045,098, entitled "Positive Displacement Pump With Shaft-Mounted Sleeve" filed Jul. 25, 2018. The entire disclosure of the aforementioned application is incorporated herein by reference for all purposes.

BACKGROUND

The present disclosure relates to rotary positive displacement pumps. More particularly, this disclosure relates to sealing arrangements that can be used to seal the rotary components of a positive displacement pump.

Pumps, such as rotary positive displacement pumps, can be used to transport pumped products (e.g., fluids) through a system. In a rotary positive displacement pump, two or more counter-rotating lobes are disposed in a cavity typically defined by a pump body and an associated cover. This cavity has an inlet on one side of the rotary lobes through which the pumped product is initially received and an outlet on the other side of the rotary lobes through which the pumped product is forced out of the pump. A gear case, which typically supports the pump body, has shafts that attach to the rotors. When the gear case drives the rotation of these shafts, the attached rotors rotate, thereby causing the pumping action.

Although positive displacement pumps of the type described above have existed for some period of time, the continued maintenance and service of these pumps has presented unique challenges. Various components, including the internal seals, may need periodic replacement. The process for replacing these components can be both time-consuming and difficult, and can require material handling equipment to perform. With thousands of pumps of this kind in service throughout the world, there is a continued need for improvements.

SUMMARY

A rotary positive displacement pump provides an improved sealing arrangement between the pump body and the gear case including an interposed sleeve with a static seal between a rotor and the sleeve and with a dynamic seal between the sleeve and a forward part of the hub. The seal and wear components are easily accessible for service, replacement, or other maintenance with minimal pump disassembly. For example, the pump body does not need to be removed from the gear case and the inlet and outlet do not need to be disconnected from attached lines. Accordingly, the forward positioning of the sealing and the wearing component (i.e., the sleeve) allow for significantly reduced pump downtimes related to cleaning and maintenance operations.

According to one aspect, the rotary positive displacement pump includes a gear case having a pair of shafts extending away from the gear case at a forward end. A pump body is supported by the gear case on the forward end of the gear case. The pump body has a cover attached thereto, which together define a cavity between the pump body and the cover. The cavity has an inlet and an outlet and the pump body has a pair of hubs that extend into the cavity in which each of the pair of hubs has an axially-extending opening. A corresponding one of the pair of shafts from the gear case is received through each one of the axially-extending openings of the hubs. A pair of rotors each have a central portion received on one of the pair of shafts inside the axially-extending opening of the hub. Each rotor has wings attached to the central portion of the rotor in which the wings of the rotor are disposed radially outward of the hub when the central portion of the rotor is attached to the shaft. The rotors on the pair of shafts are rotatable in opposite directions to pump a pumped product through the pump body from the inlet to the outlet. Notably, the rotary positive displacement pump also includes a pair of sleeves each having a respective sealing arrangement. Each of the pair of sleeves have a wall extending circumferentially along and about a longitudinal axis to define a central opening therein. The central opening of each of the pair of sleeves receives a corresponding one of the pair of shafts such that each of the pair of sleeves is configured to rotate in concert with the corresponding one of the pair of shafts. The pair of sealing arrangements inhibit escape of the pumped product from the cavity to a surrounding atmosphere and each of the pair of sealing arrangements have a dynamic seal and a static seal. The dynamic seal is positioned forwardly in the axially-extending opening of the hub and against a radially outward-facing surface of the sleeve. The static seal is positioned forwardly within the central opening of the sleeve and abuts a radially inward-facing surface of the sleeve and the rotor. Both of these seals are readily accessible when servicing the pump without removing the pump body from the gear case.

These and still other advantages of the disclosure will be apparent from the detailed description and drawings. What follows is merely a description of some preferred embodiments of the present disclosure. To assess the full scope of the disclosure, the claims should be looked to as these preferred embodiments are not intended to be the only embodiments within the scope of the claims.

BRIEF DESCRIPTION OF DRAWINGS

The invention will be better understood and features, aspects and advantages other than those set forth above will become apparent when consideration is given to the following detailed description thereof. Such detailed description makes reference to the following drawings.

Figure 1:
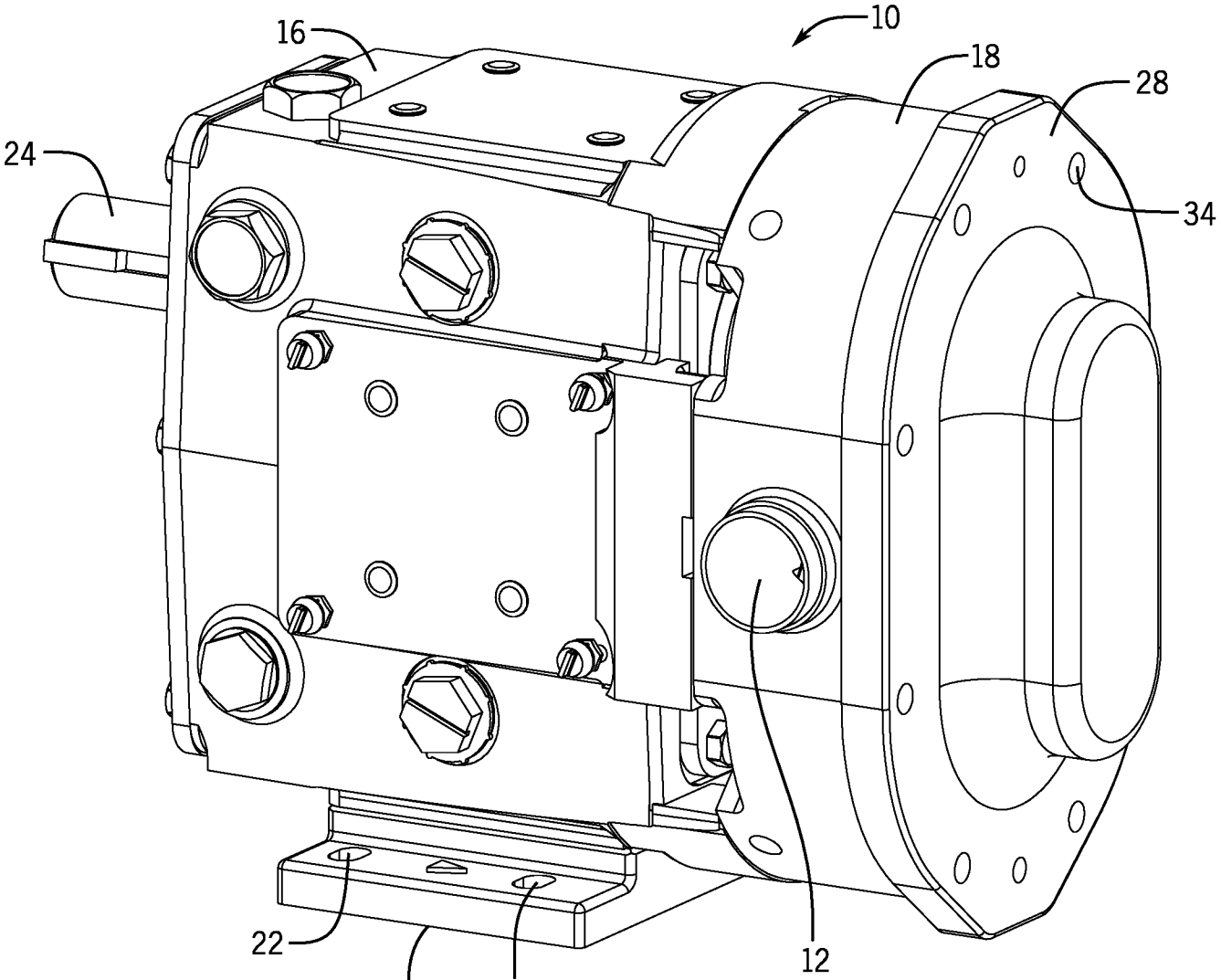
FIG. 1 is a perspective view of a rotary positive displacement pump.

Corresponding reference characters indicate corresponding parts throughout the several views. Although the drawings represent embodiments of the present disclosure, the drawings are not necessarily to scale and certain features may be exaggerated in order to better illustrate and explain the embodiments of the present disclosure.

DETAILED DESCRIPTION

For the purposes of promoting an understanding of the principles of the present disclosure, reference will now be made to a number of illustrative embodiments shown in the attached drawings and specific language will be used to describe the same.

Figure 2:
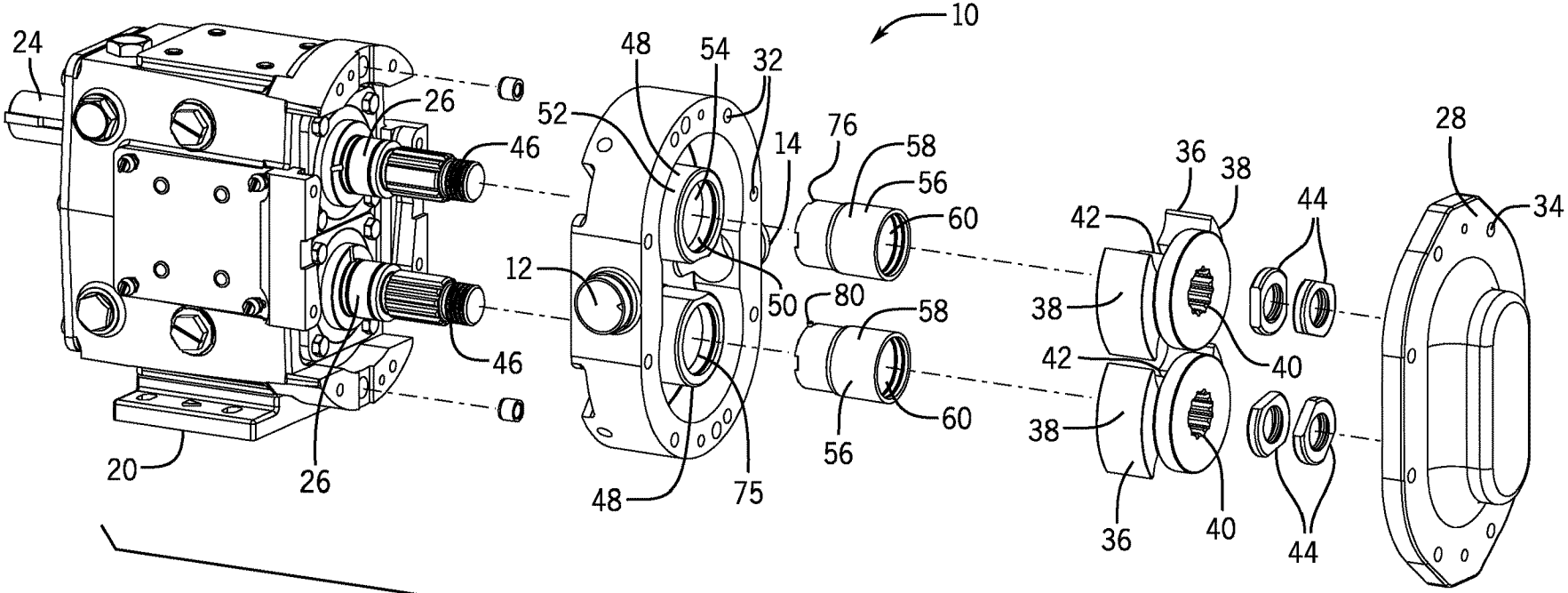
FIG. 2 is an exploded view of the rotary positive displacement pump of FIG. 1.
Figure 3B:
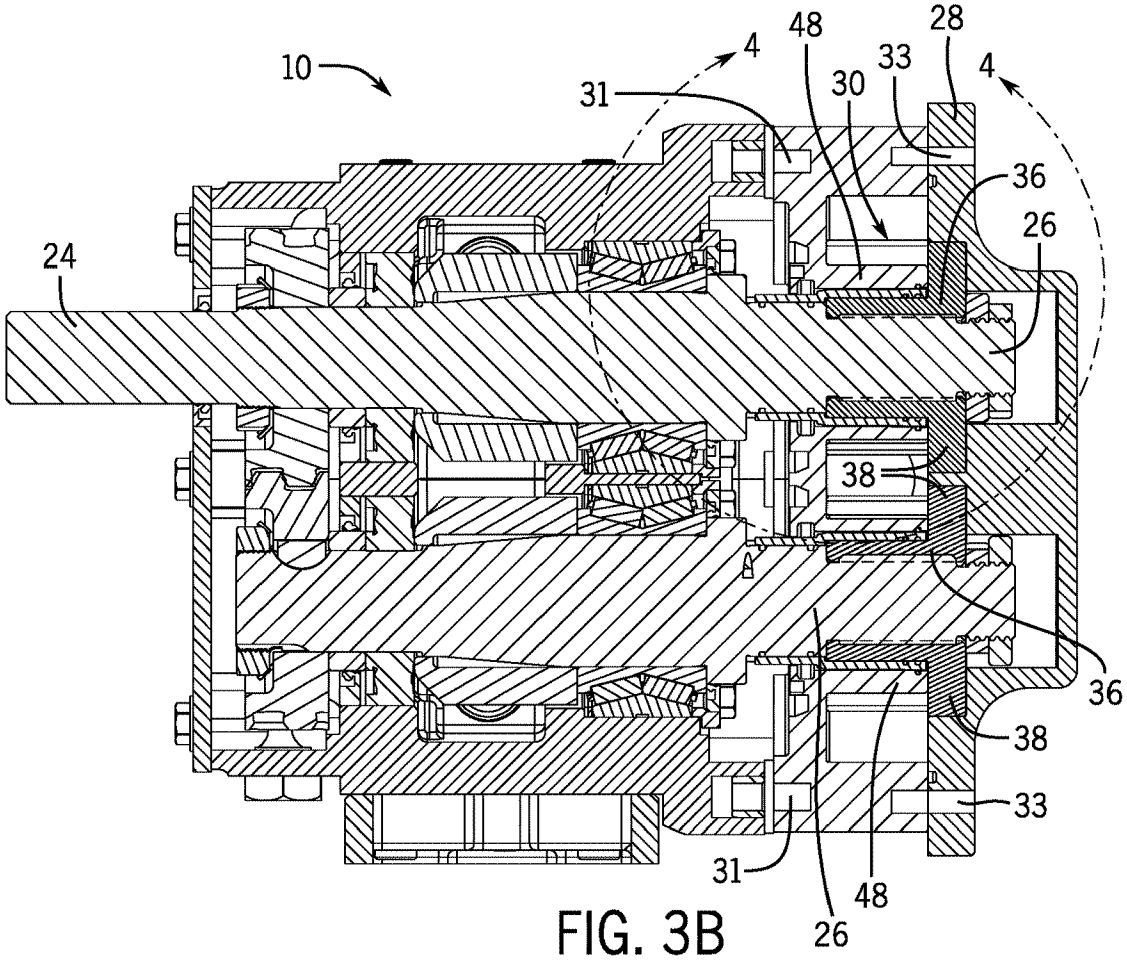
FIG. 3B is a cross-sectional side view of the rotary positive displacement pump taken along line 3B-3B of FIG. 3A.
Figure 3A:
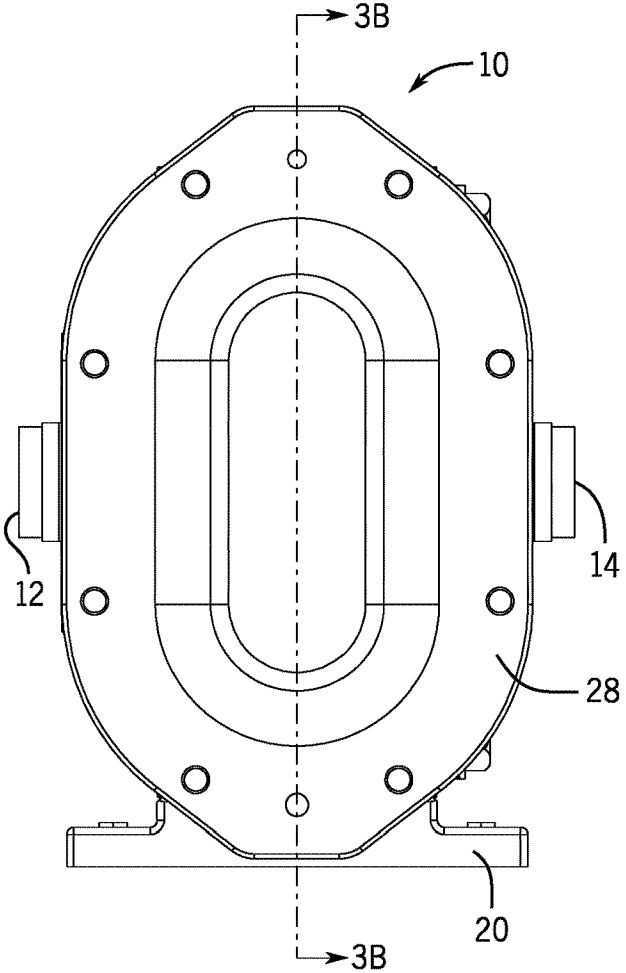
FIG. 3A is a front view of the rotary positive displacement pump of FIG. 1.

FIGS. 1, 2, 3A, 3B, and 4 illustrate an embodiment of a rotary positive displacement pump 10 according to the disclosure. The pump 10 can be a circumferential piston pump, for example, which is a type of rotary positive displacement pump. The pump 10 can be used during the production of toothpaste, cosmetics, chocolate, candies, pet food, and other viscous materials to transport slurries or materials throughout a production facility, for example. As best seen in FIGS. 1 and 3A, materials can be inputted into the pump 10 through an inlet line 12, through the pump 10, and into the outlet line 14 at a higher pressure or velocity. Inlet and outlet are relative terms, however, based on the direction in which the pump 10 is being run, and the inlet and outlet could be reversed.

Generally speaking, the pump 10 includes a gear case 16 with a forward end that supports a pump body 18 on a rearward end of the pump body 18. The gear case 16 and the pump body 18 may be connected to one another in a number of ways, including using bolts or other fasteners. In some embodiments, the fasteners are readily removable to allow access to the forward end of the gear case 16 or to allow for easy removal of the pump body 18 for service. Portions of the gear case 16 including shafts and other rotary components extend into the pump body 18 through the rear side of the pump body 18.

A mounting base 20 is attached to the gear case 16, and can be used to couple the pump 10 to the floor or other mounting surface. Although shown in an upright orientation, the mounting base 20 allows the gear case 16 to be mounted in a variety of orientations, including bottom, top, and side mounting arrangements. The mounting base 20 can be provided with a number of holes 22 which can receive fasteners or other anchoring equipment to secure the pump 10 in a desired location and orientation.

Figure 4:
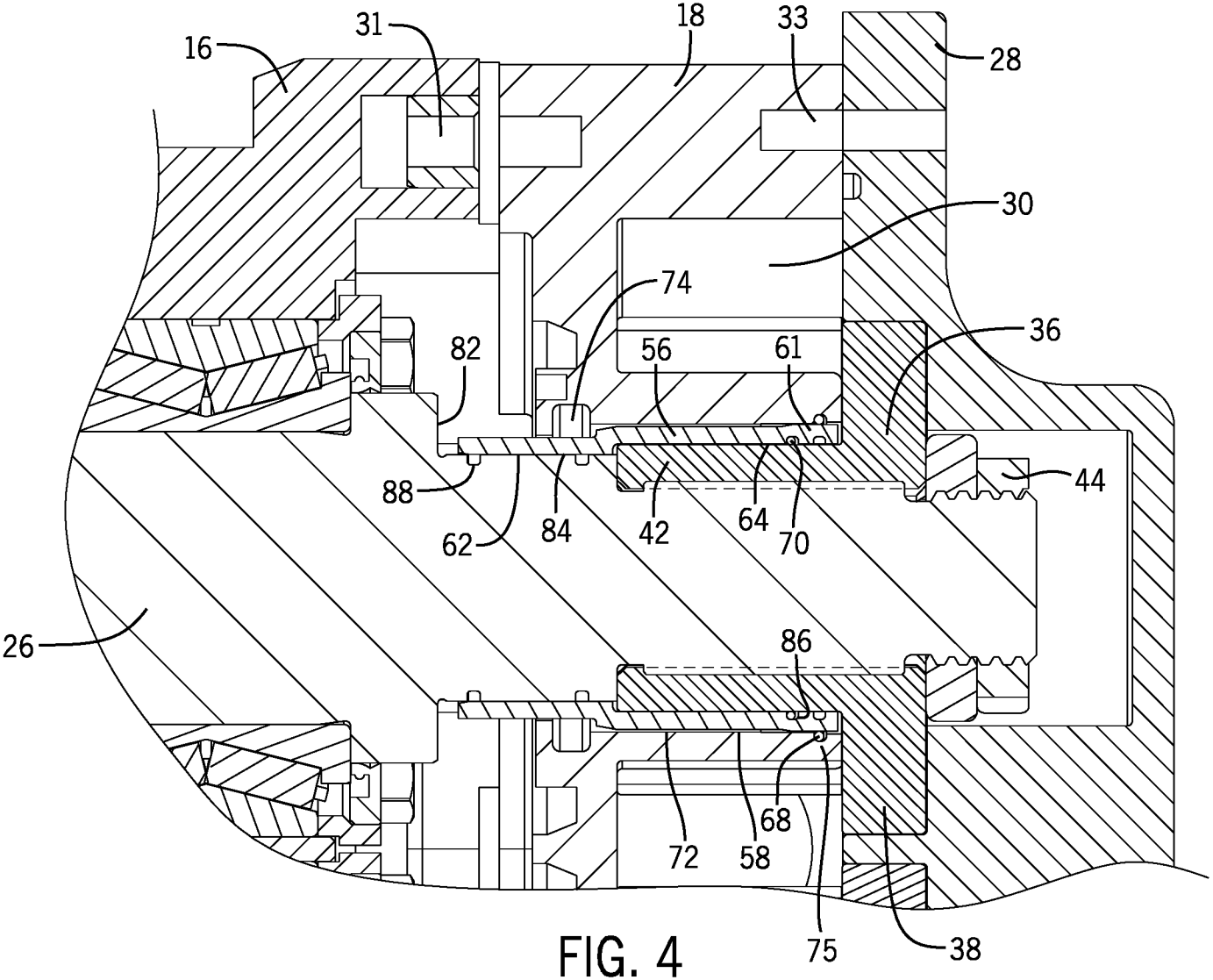
FIG. 4 is a detailed view of a sealing arrangement in the rotary positive displacement pump of FIG. 3B, taken along lines 4-4 in FIG. 3B.

With particular reference now to FIGS. 2, 3B, and 4, the driving and sealing components of the pump 10 are illustrated. The gear case 16 is adapted to translate a single input rotary torque into a pair of counter-rotational output rotary torques. In pump 10, the gear case 16 is configured or adapted to receive an input rotary torque from a keyed input shaft 24 at the rear end of the gear case 16. The keyed input shaft 24 can be coupled to a motor (not shown) using a coupling (not shown) that imparts the input torque onto the input shaft 24. The torque generated by the motor and translated to the input shaft 24 is then translated and divided within the gear case 16 into a pair of counter rotational output shafts 26 that are positioned on the front end of the gear case 16. The pair of output shafts 26 can be positioned parallel to one another, and can also be positioned parallel to the input shaft 24. Because the translation and division of such torques and rotary motion is known within the gear case art, a greater description of the interior of the gear case 16 is unnecessary. Moreover, it will be appreciated that other styles of gear cases might be used with the improvements described herein.

The pump body 18 includes a cover 28. Together with the pump body 18, the cover 28 defines a cavity 30 that can receive rotary and sealing components therein. As best illustrated in FIG. 3B, the cavity 30 can be formed between the pump body 18 and the cover 28 and can be configured to receive and handle viscous materials therein. The cover 28 can be removably coupled to the pump body 18 using fasteners, for example. In some embodiments, the cover 28 and pump body 18 are each supported by studs or connectors that are fastened or otherwise anchored to the gear case 16. A first set of studs 31 can extend forwardly away from the gear case 16 into a set of holes formed in the rear end of pump body 18, while a second set of fasteners (not shown) such as a threaded stud with a handle to accommodate turning can be received at openings 33 that extend into the front end of the pump body 18 through the holes 34 of the cover 28. Nuts or other fastening handles can be threaded onto the studs to secure the cover 28, pump body 18, and gear case 16 to one another and different fastening or connecting arrangements might be used. For example, the fastening handles shown and described in U.S. Pat. No. 9,062,676, entitled "Positive Displacement Pump with Improved Sealing Arrangement and Related Method of Making" can be used to secure the cover 28 to the pump body 18. The contents of the aforementioned patent are incorporated by reference in their entirety.

As explained above and as depicted in FIGS. 2, 3B, and 4, the cavity 30 can house rotary and sealing components of the pump 10. A pair of intermeshed rotors 36 are coupled to one of each of the output shafts 26. The rotors 36 are removably coupled to the output shafts 26, which drive rotation of the rotors 36 to produce pumping action. As described in the previously-mentioned U.S. Pat. No. 9,062,676, the rotors 36 can have wings 38 that are angularly offset from one another by 90 degrees, such that they intermesh with one another.

The rotors 36 are coupled to the output shafts 26 by telescopically inserting a splined opening 40 of a central portion 42 of the rotor 36 onto an inversely shaped body of the output shaft 26. In the form illustrated, with the profile of the splined opening 40 having a similar cross-sectional profile to the respective shaft 26 onto which the rotor 36 is received, the rotor 36 is precisely angularly driven by the rotation of the shaft 26 via the splined engagement. Of course, other types of engagement may also be used such as, for example (but not limited to), keyed engagement. Fasteners 44 are coupled to a threaded, forward end 46 of the output shaft 26 to secure the rotor 36 to the output shaft 26, which restricts relative axial movement therebetween.

The central portion 42 of the rotors 36 is received within one of two hubs 48 formed in the pump body 18. The hubs 48 are generally cylindrically tubular shaped and protrude from the rear or base wall of the pump body 18. Each of the pair of hubs 48 have a radially inward facing surface 50 and a radially outward facing surface 52. As shown in FIG. 2, the radially outward facing surface 52 may extend around only a portion of the total circumference of the hub 48, because a cutout region is needed to accommodate the passage of the wings 38 of the rotors 36, which extend radially outward from the hub 48. Each of the pair of hubs 48 has an axially-extending opening 54 in which one of the pair of output shafts 26 of the gear case 16 and one of the pair of rotors 36 is received and secured. Specifically, the central portion 42 of the rotors 36 is received within the axially-extending opening 54 of the hub 48.

Notably, a pair of sleeves 56 are also received within the cavity 30. Specifically, one of each of the pair of sleeves 56 is received in the axially-extending opening 54 of each hub 48 and is interposed between the shaft 26 (with which the sleeve 48 is rotationally coupled) and the radially inward facing wall of the hub 48.

Each sleeve 56 includes a wall 58 extending circumferentially along and about a longitudinal axis X-X to define a central opening 60 therein. The forward end of each of the pair of sleeves can have a boss 61 protruding outwardly therefrom. The generally cylindrical outer shape of the wall 58 can taper outward to form the boss 61, which can be used to support sealing arrangements, as explained in more detail below.

With specific reference to FIGS. 3B and 4, the sleeve 56 profile and positioning within the greater assembly of pump 10 is shown in additional detail. The central opening 60 of the sleeve 56 is received on the shaft 26 and the sleeve 56 is secured on the shaft 26 by the attachment of the rotor 36 to the shaft 25 (with the central portion 42 of the rotor 36 being received between the forward end of the shaft 26 and the sleeve 26 such that the sleeve 26 is radially positioned between the central portion 42 of the rotor 36 and the radially inward facing wall of the hub 48). To accommodate and closely fit these components of different sizes, the central opening 60 of the sleeve 56 can have a varying shape. For example, the central opening 60 of the sleeve 56 can be defined by a rear section 62 and a forward section 64. The rear section 62 can be defined by a radius smaller than the radius defining the forward section 64, since the rear section 62 surrounds a portion of the shaft 26, while the forward section receives the central portion 42 of the rotor 36, which has a greater diameter than some portions of the shaft 26.

The sleeve 56, along with a sealing arrangement between the sleeve 56, the shaft 26, and the hub 48, help inhibit the escape of the pumped product from the cavity 30 to the surrounding atmosphere. Sealing arrangements are located about each shaft 26 and rotor 36, and typically include at least one dynamic seal 68 and at least one static seal 70. As shown in FIG. 4, the dynamic seal 68 is positioned forwardly in the axially-extending opening 54 of the hub 48 and against a radially outward facing surface 72 of the sleeve 56. In the context used, "forwardly" in the axially-extending opening 54 means "within" the axially-extending opening 54 of the hub 48. The dynamic seal 68 could be positioned just forward of the rear surface 74 of the axially-extending opening 54, within the forward-most half of the axially-extending opening 54 of the hub 48, or within a forward-most quadrant of the axially-extending opening 54 of the hub 48, for example.

In some embodiments, the dynamic seal 68 is positioned against a radially-outward facing surface of the boss 61. As shown, the boss 61 can be received entirely within the axially-extending opening 54 of the hub 48, and rearward from the wings 38 of the rotor 36. In some embodiments, the wings 38 of the rotor 36 can restrict axial movement of the sleeve 56 relative to the shaft during pump 10 operation.

Typically, a circumferentially-extending groove 75 is formed within the radially inward facing surface of the axially-extending opening 54 to receive the dynamic seal 68 therein. The circumferentially-extending groove 75 can be formed into the axially-extending opening 54 in a number of ways, including casting, milling, or other suitable machining operations. By placing the dynamic seal 68 (here, an o-ring) in the groove 75 of the hub, the o-ring can remain fix relative to the hub 48 and any wear occurs between the o-ring and the sleeve 56, which sleeve 56 can be sacrificial and easily replaced relative to the other larger components (i.e., the pump body 18) of the pump 10.

Due to the limited thickness of material present in this portion of the hub 48 and the difficulty in adequately sealing the axially-extending opening 54 from fluid entry, dynamic seals 68 and grooves 75 have traditionally been positioned outside of the axially-extending opening 54 of the hub 48, where more robust seals can be easily positioned. The limited cross-section of the axially-extending opening 54 of the hub 48 presents machining challenges that have prevented others from placing a dynamic seal 68, such as that illustrated, forward in the axially-extending opening 54 of the hub 48. With the elongated sleeve 56 design incorporated into the pump 10, however, the forward location of the groove 75 and the dynamic seal 68 together provide sealing between the sleeve 56 and the hub 48. In the orientation shown, the sleeve 56 (which as mentioned above can be considered a sacrificial wear component) and dynamic seal 68 can be removed and replaced easily, without removing the pump body 18 from the gear case 16, saving time and labor during cleaning and servicing of the pump 10, as the entire pump body 18 does not need to be removed to access rearwardly positioned seals.

Accordingly, the dynamic seal 68 provides a seal between the radially outward facing surface of the sleeve 56 and the radially inward facing surface of the hub 48, with the sleeve 56 (along with the shaft 26 and the rotor 36) rotating relative to the hub 48 as pump 10 operates. In order to drive the sleeve 56 in concert with the shaft 26, one or more axially-extending notches 76 may be formed in a rear surface 78 of the sleeve 56. One of the axially-extending notches 76 receive a pin 80 extending radially outward from the shaft 26. Although one notch is sufficient, it is contemplated that multiple notches can be present to make it easier to locate the pin in one of the notches during placement of the sleeve on the shaft (that is, to find an angular position in which the pin is accepted into one of the slots). For example, in the illustrated embodiment, four notches offset by 90 degrees from one another are present. In some embodiments, the pin 80 is pressed into the shaft 26, and can have a generally cylindrical shape. The notch 76 can be defined by an arc length at least two times larger than the width (e.g., the diameter) of the pin 80, which can ease the installation of the sleeve 56 onto the shaft 26 during assembly. With this construction, when the shaft 26 rotates, the pin 80 coupled to the shaft 26 rotates as well, and engages the notch 76, thereby causing the sleeve 56 to rotate in concert with the shaft 26. Axial movement of the sleeve 56 is restricted by the wings 38 of the rotors 36 and a shoulder 82 formed in the shaft 26 which is generally achieved by capturing the sleeve 56 on the shaft 26 by securing the rotor 36 on the shaft 26.

As mentioned above, there is also a static seal 70 provided between the sleeve 56 and the rotor 36. The static seal 70 is also positioned forwardly within the opening of the sleeve. A groove 86 may be present within a radially inwardly-facing surface of the sleeve 56 and can receive the static seal 70 (typically an o-ring) such that the static seal 70 forms a seal between the radially inward-facing surface of the sleeve 56 and a radially outward-facing surface of the central portion 42 of the rotor 36. Because the sleeve 56 and rotor 36 rotate together during pump operation, virtually no relative movement between the components occurs, thus enabling the use of a static seal 70.

As illustrated, the static seal 70 can be an O-ring. The O-ring can be formed of silicone, Kalrez® (or other perfluoroelastomers), nitrile rubber, Viton® (or other fluoroelastomers), ethylene propylene rubber, or other suitable materials for establishing static seals in sanitary environments. The dynamic seal 68 can be a rotary seal formed of polymeric or composite materials, for example.

It is noted that, while the static seal 70 is illustrated as being positioned between the sleeve 56 and the central portion 42 of the rotor 36, that a static seal or seals could similarly be placed along any portion of the axial length of the interface between the sleeve and the shaft and/or rotor to achieve similar sealing results as these three components rotate together as a common rotatable sub-assembly. For example, it is contemplated that a groove, such as the groove 88 on the shaft 26 might alternatively or additionally receive the static seal (although such rearward placement might make accessing and servicing the static seals more difficult).

Using the above-described sealing arrangement within the pump 10, a forward sealed rotary positive displacement pump can be effectively operated and maintained. The wear components, including the dynamic seal 68, static seal 70, and sleeve 58 effectively seal the pump cavity 30 and restrict the escape of pumped product, fluid, or contaminants from the cavity 30 into the surrounding atmosphere or environment.

The forward positioning of the wear components within the body 18 makes each of the sleeve 56, dynamic seal 68, and static seal 70 readily accessible and replaceable, in case repair or maintenance is required or desired. To access the components within the pump 10, the cover 28 can first be removed from the pump body 18. Next, a wrench or other tool can be used to remove the fasteners 44 from the forward end 46 of the shafts 26. The rotor 36 can then be pulled axially away from the shaft 26, thereby removing the splined opening 40 of the central portion 42 of the rotor 36 from the output shaft 26 and exposing the forward section 64 of the sleeve 56 along with the o-ring of the static seal 70 to the external environment. At this stage, the static seal 70 may be serviced or replaced and/or the sleeve 56 can be dislodged or displaced relative to the hub 48 by inserting a screwdriver into an available space of one of the notches 76 and slightly twisting the screwdriver to dislodge the sleeve 56 from the shaft 26. The sleeve can be further removed by inserting a pick into a forward groove on the inside of the sleeve 56 (as illustrated, this forward groove is the unnumbered forward-most groove on the inside of the central opening of the sleeve 56 in which an o-ring is not received). In some embodiments, a maintenance worker can remove the sleeve 56 by hand once the forward end 64 protrudes outward from the hub 48. The screwdriver can be used once again to remove the dynamic seal 68 from the groove 75, should it be necessary.

To reassemble the pump, the dynamic seal 68 can be initially fitted into the groove 75 of the hub 48. Next, the sleeve 56 is passed into the axially-extending opening 54 of the hub, until the rear section 62 of the sleeve engages the shoulder 82. In order to produce engagement between the rear section 62 of the sleeve and the shoulder 82, the pin 80 should be radially positioned within the axially-extending notch 76 formed in the sleeve 56. Because the axially-extending notch 76 is defined by an arc length at least twice the width of the pin 80, the necessary angular positioning precision of the sleeve 56 relative to the shaft 26 is relaxed, which helps decrease installation time. Once the sleeve 56 is properly positioned within the hub 48, the static seal 70 can be received in the groove 86 (if it was not already in the sleeve) and the rotor 36 can be replaced, so that the splined opening 40 reengages the output shaft 26. The fasteners 44 can be recoupled to the forward end of the shaft 46, which locks the axial positioning of the rotor 36 and the sleeve 56. Then, the cover 28 can be recoupled to the pump body 18, so that the cavity 30 is restored and pump operation can resume.

Finally, it should be appreciated that because the pump 10 has a pair of shafts 26, rotors 36, and hubs 48, that there can be a corresponding sleeve 56 and corresponding sealing arrangement (i.e., static and dynamic seals) at each one of the shaft-rotor-hub assemblies. Although this should be apparent from the figures and description above, it is nonetheless expressly stated to make clear that there are in fact a pair of sleeves (each with a respective sealing arrangement) at each of the shafts, rotors and hub sets.

It should be appreciated that various other modifications and variations to the preferred embodiments can be made within the spirit and scope of the disclosure. Therefore, the disclosure should not be limited to the described embodiments. To ascertain the full scope of the disclosure, the following claims should be referenced.

What is claimed is:

1. A rotary positive displacement pump for pumping a pumped product, the rotary positive displacement pump comprising:

a gear case including a pair of shafts extending therefrom at a forward end;

a pump body supported by the gear case on the forward end of the gear case, the pump body having a cover attached thereto so as to define a cavity between the pump body and the cover in which the cavity has an inlet and an outlet, the pump body having a pair of hubs that extend into the cavity in which each of the pair of hubs has an axially-extending opening through each one of which a corresponding one of the pair of shafts from the gear case is received;

a pair of rotors, each of the pair of rotors having a central portion received on one of the pair of shafts inside the axially-extending opening of the hub, each of the pair of rotors having wings attached to the central portion of the rotor in which the wings of the rotor are disposed radially outward of the hub when the central portion of the rotor is attached to the shaft, the rotors on the pair of shafts being rotatable in opposite directions to pump the pumped product through the pump body from the inlet through the cavity to the outlet;

a pair of sleeves, each of the pair of sleeves having a wall extending circumferentially along and about a longitudinal axis to define a central opening therein, the central opening of each of the pair of sleeves receiving a corresponding one of the pair of shafts, and each of the pair of sleeves configured to rotate in concert with the corresponding one of the pair of shafts; and a pair of sealing arrangements corresponding to the respective pairs of shafts and sleeves to inhibit the escape of the pumped product from the cavity to a surrounding atmosphere, each of the pair of sealing arrangements having a dynamic seal and a static seal in which the dynamic seal is positioned forwardly in the axially-extending opening of the hub and against a radially outward-facing surface of the sleeve and in which the static seal is positioned forwardly within the central opening of the sleeve and abuts a radially inward-facing surface of the sleeve and the rotor.

2. The rotary positive displacement pump of claim 1, wherein a rear surface of the sleeve is positioned adjacent a radially outward-extending shoulder of the shaft and a forward surface of the sleeve is positioned adjacent the wings of the rotor.

3. The rotary positive displacement pump of claim 2, wherein an axially-extending notch is formed in the rear surface of the sleeve.

4. The rotary positive displacement pump of claim 3, wherein a pin extends radially outwardly from the shaft and into the axially-extending notch in the sleeve.

5. The rotary positive displacement pump of claim 4, wherein the pin is pressed into the shaft.

6. The rotary positive displacement pump of claim 4, wherein the axially-extending notch of the sleeve has an arc length that is at least two times larger than a width of the pin.

7. The rotary positive displacement pump of claim 6, wherein the pin has a cylindrical shape and the width of the pin corresponds to a diameter of the pin.

8. The rotary positive displacement pump of claim 1, wherein the static seal is an o-ring.

9. The rotary positive displacement pump of claim 8, wherein the o-ring is formed from a material chosen from the group consisting of silicone, perfluoroelastomer, nitrile rubber, fluoroelastomer, and ethylene propylene rubber.

10. The rotary positive displacement pump of claim 1, wherein a groove extends circumferentially about the axially-extending opening to receive the dynamic seal therein.

11. The rotary positive displacement pump of claim 1, wherein the dynamic seal and the static seal are positioned within a forward-most half of the axially-extending opening of the hub.

12. The rotary positive displacement pump of claim 11, wherein the dynamic seal and the static seal are positioned within a forward-most quarter of the axially-extending opening of the hub.

13. The rotary positive displacement pump of claim 1, wherein the central opening of each of the pair of sleeves includes a rear section defined by a first radius and a forward section defined by a second radius in which the second radius is larger than the first radius.

14. The rotary positive displacement pump of claim 13, wherein each forward section of the pair of sleeves receives the central portion of one of the pair of rotors therein.

15. The rotary positive displacement pump of claim 13, wherein the static seal abuts a radially inward-facing surface of the front section of the sleeve.

16. The rotary positive displacement pump of claim 15, wherein the static seal is received within a groove formed in the sleeve.

17. The rotary positive displacement pump of claim 1, wherein a forward end of each of the pairs of sleeves includes a boss protruding therefrom.

18. The rotary positive displacement pump of claim 17, wherein the dynamic seal is positioned against a radially-outward facing surface of the boss.

19. The rotary positive displacement pump of claim 17, wherein the boss is received entirely within the axially-extending opening of the hub.

20. The rotary positive displacement pump of claim 1, wherein the static seal is fixed in position with respect to the sleeve and the rotor and rotates with the sleeve and the rotor so there is no relative motion between the static seal, the sleeve, and the rotor and further wherein the dynamic seal is fixed with respect to the hub while the sleeve moves relative to the dynamic seal and the hub.

* * * * *